US005690562A

United States Patent [19]

Sturm

[11] Patent Number: 5,690,562

[45] Date of Patent: Nov. 25, 1997

[54] SOFT IMPACT PUTTER

[76] Inventor: Ernst F. Sturm, 9612 Magnolia Dr., Hillsboro, Mo. 63050

[21] Appl. No.: 707,003

[22] Filed: Sep. 3, 1996

[51] Int. Cl.[6] ..... A63B 53/04

[52] U.S. Cl. ..... 473/340; 473/342; 473/350; 473/335; 473/329

[58] Field of Search ..... 473/342, 350, 473/341, 340, 329, 335; 273/78, 173

[56] References Cited

U.S. PATENT DOCUMENTS

| | | | |
|---|---|---|---|
| 838,284 | 12/1906 | Thompson et al. | 473/329 |
| 3,815,910 | 6/1974 | Raines | 473/340 |
| 4,121,832 | 10/1978 | Ebbing | 473/340 |
| 4,156,526 | 5/1979 | Huggins et al. | 473/329 |
| 5,026,056 | 6/1991 | McNally et al. | 473/350 |
| 5,190,290 | 3/1993 | Take | 473/342 |
| 5,332,223 | 7/1994 | Johnson | 473/342 |
| 5,425,535 | 6/1995 | Gee | 473/350 |
| 5,464,218 | 11/1995 | Schmidt | 473/341 |
| 5,575,472 | 11/1996 | Magerman et al. | 473/342 |

*Primary Examiner*—Mark S. Graham
*Attorney, Agent, or Firm*—Henry W. Cummings

[57] ABSTRACT

In accordance with the present invention, a golf putter head is provided having a body portion which includes a front face having an opening which extends all the way from the front face through the body portion. An elastomeric material having a Durometer value to produce substantial resilience is located within this opening in such a manner that there is no metal backing for the elastomeric material. In one embodiment the opening extending inwardly from the front face also extends downwardly to the bottom surface of the putter to assist in locating the elastomeric material within the putter. In accordance with another embodiment of the invention the front face of the putter includes latterly spaced slots on either side of the opening. These slots further assist in locating the elastomeric material within the body portion. In another embodiment of the invention a pair of vertical walls are provided which are connected to a rear face of the body portion and are located perpendicular to the putting surface. These walls are used to facilitate mounting of a putter guiding assembly and optional putter weights. The guiding assembly may include an upper surface which is triangular in shape with a point indicating the direction of movement of the ball.

15 Claims, 3 Drawing Sheets

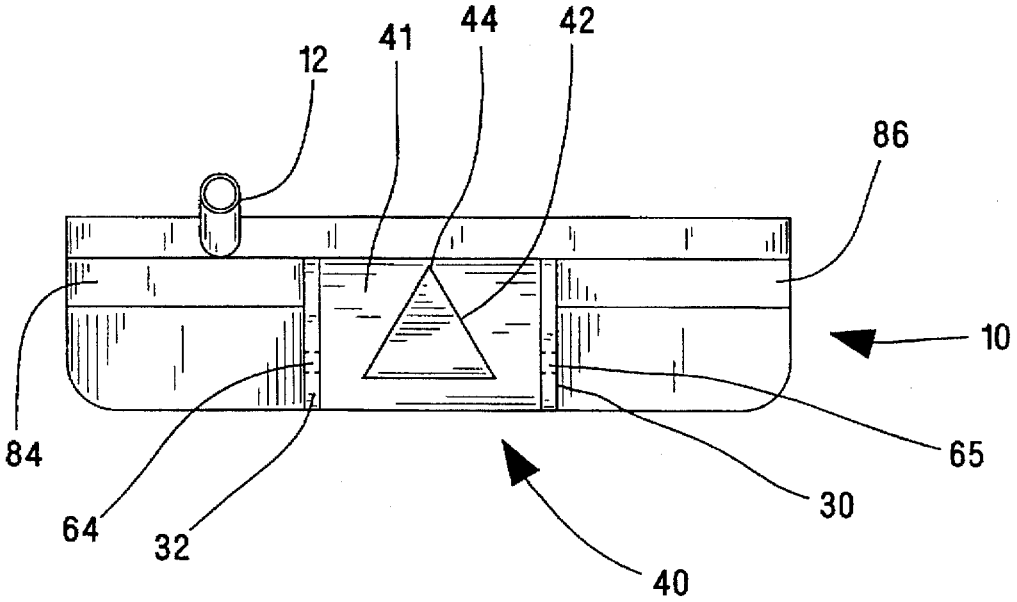
FIG. 5
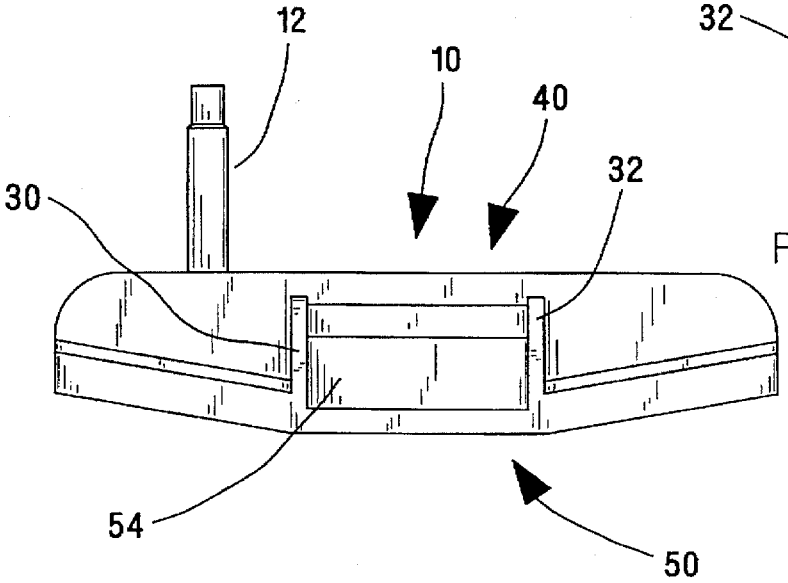
FIG. 5A
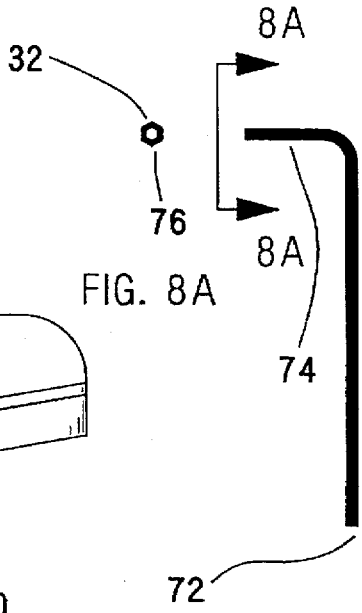
FIG. 8A
FIG. 8

SOFT IMPACT PUTTER

I. FIELD OF THE INVENTION

This invention relates to golf putters and in particular to golf putters containing an elastomeric insert which produces a more resilient feel than putters having an elastomeric striking surface with a metal backing.

II. BACKGROUND OF THE INVENTION

U.S. Pat. No. 3,211,455 discloses a putter having an elastomeric face which is supported by a metal backing plate.

U.S. Pat. No. 3,937,474 discloses a golf club, for example, a wood, having a polyurethane striking surface with a rigid backing.

U.S. Pat. No. 4,422,638 discloses a putter having an elastomeric face and a metal backing.

III. SUMMARY OF THE INVENTION

A. Objects of the Invention

The object of the present invention is to provide a putter having an elastomeric putting surface which produces a more resilient feel as the putter strikes the ball than previous putters having an elastomeric striking face and a rigid backing..

B. Summary

In accordance with the present invention, a golf putter head is provided having a body portion which includes a from face having an opening which extends all the way from the from face through the body portion. An elastomeric material having a Durometer value to produce substantial resilience is located within this opening in such a manner that there is no metal backing for the elastomeric material. In one embodiment the opening extending inwardly from the front face also extends downwardly to the bottom surface of the putter to assist in locating the elastomeric material within the putter. In accordance with another embodiment of the invention the front face of the putter includes latterly spaced slots on either side of the opening. These slots further assist in locating the elastomeric material within the body portion. In another embodiment of the invention a pair of vertical walls are provided which are connected to a rear face of the body portion and are located perpendicular to the putting surface. These walls are used to facilitate mounting of a putter guiding assembly and optional putter weights. The guiding assembly may include an upper surface which is triangular in shape with a point indicating the direction of movement of the ball. In another embodiment of the invention the weights may be located below the guiding assembly surface and a variety of different weights may be utilized for various green speeds. In one embodiment the guiding assembly and/or the optional weights are held in place within the vertical members with one or more mechanical fasteners.

IV. BRIEF DESCRIPTION OF THE DRAWINGS

FIG. 5 is a plan view of a guiding assembly for use in the present invention.

FIG. 5A is a rear view of the putter of the present invention.

FIG. 8 is a side elevation view of a tool to install screws which may be used in the present invention.

FIG. 8A is a bottom view of the tool shown in FIG. 8, looking in the direction of the arrows along the line 8A—8A in FIG. 8.

V. DESCRIPTION OF PREFERRED EMBODIMENTS

Figure 1:
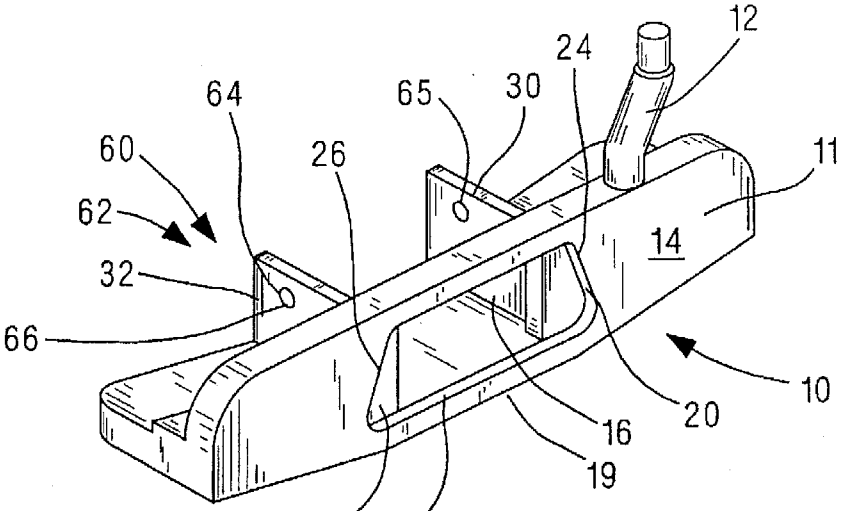
FIG. 1 is a perspective view of the golf putter of the present invention with the elastomeric material removed for clarity.

The putter of the present invention is indicated in the drawings generally at 10.

The putter includes a body portion 11 and a conventional putter shaft (12) shown partially is connected to one end portion 13 of the body portion 11.

Figure 4:
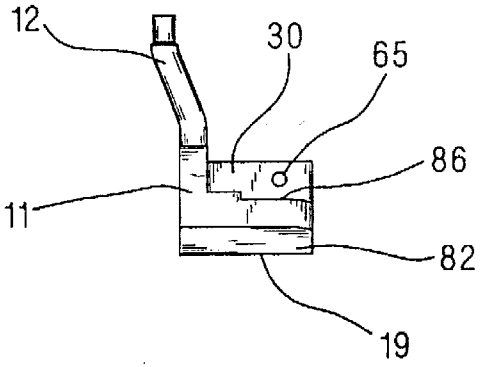
FIG. 4 is a side view of the golf putter of the present invention looking in the direction of the arrows along the line 4—4 in FIG. 1.
Figure 3:
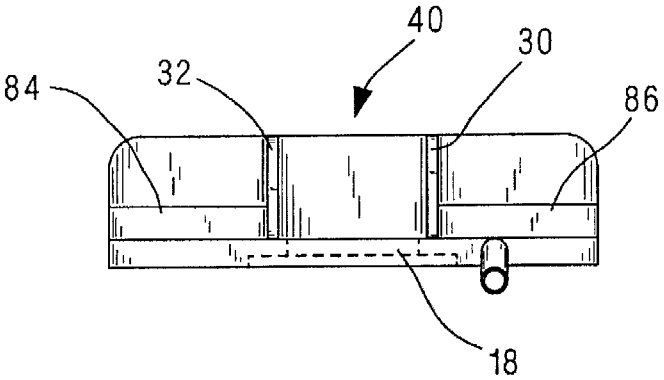
FIG. 3 is a plan view of the golf putter of the present invention with the alignment assembly and weight assembly removed for clarity.
Figure 2:
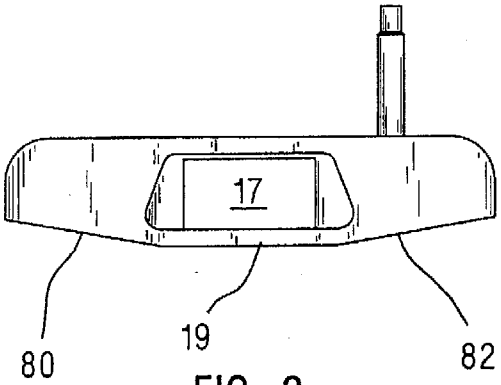
FIG. 2 is a front view of the golf putter of the present invention with the elastomeric material in place.
Figure 6:
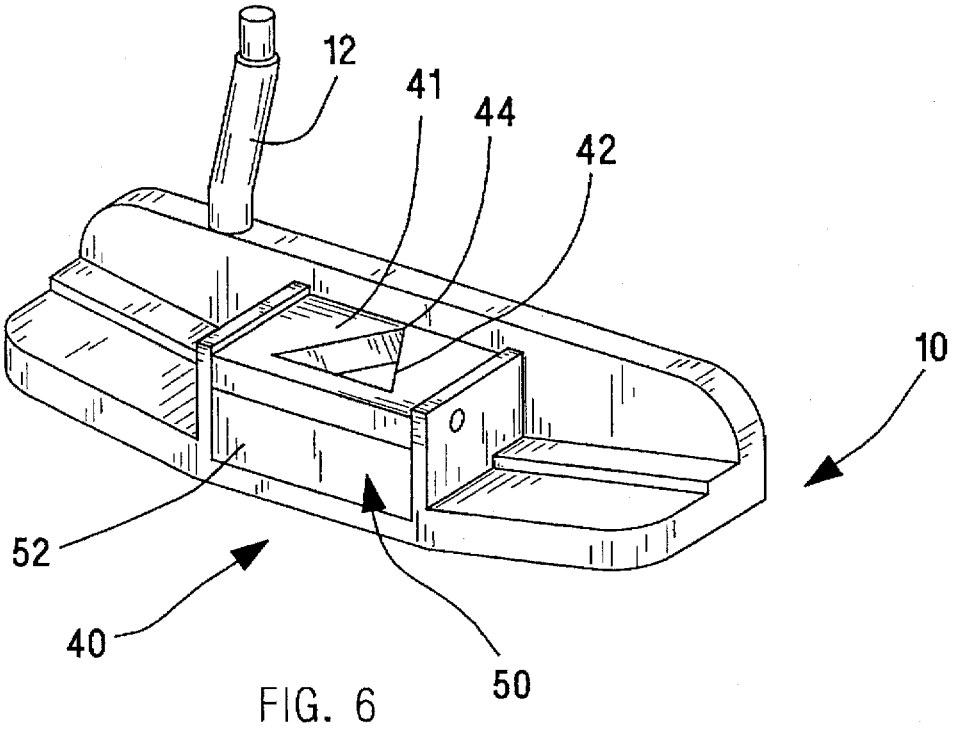
FIG. 6 is a perspective view of the golf putter of the present invention illustrating the alignment assembly and weight assembly.
Figure 6A:
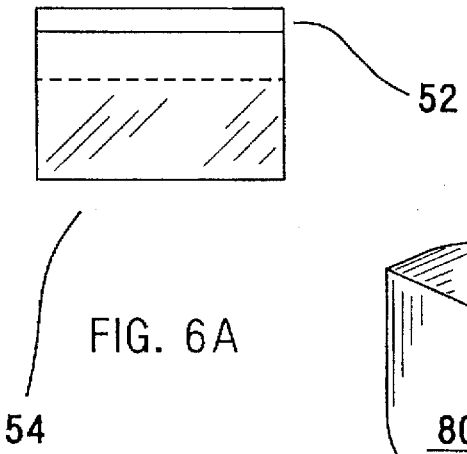
FIG. 6A is a rear view showing an installed weight.

The putter body portion (11) further includes a front face (14) preferably made of metal having an opening therein (16) which extends the full distance from the front face (14) through the body portion (11). The opening (16) preferably further includes a downwardly extending slot (18) which extends down to the bottom surface (19) of the putter as indicated in FIGS. 3 and 4.

The opening (16) may include laterally spaced extensions (20) and (22) along the front face of the putter which in one embodiment may be milled surfaces, or these surfaces may be formed by casting. These slot extensions are larger at the bottom than at the top and thus inclined surfaces (24) and (26) are defined.

The putter body portion (11) is preferably made of metal, for example, made of aluminum alloy or copper alloy, preferably brass or bronze.

Located within the opening (16) is an elastomeric material (17) having sufficient resilience such as to achieve a more resilient feel than putters currently on the market. Preferably the elastomeric material should have a Durometer value of at least about 60 D scale. The Durometer value is such as to achieve a more resilient feel than, for example, the feel produced according to U.S. Pat. No. 4,422,638 which has an elastomeric from face but is provided with a metal backing. An example of a suitable resilient elastomeric material is Uniroyal Adiprene L-275, a tradename of the Uniroyal Chemical Co. In accordance with the present invention, the use of the elastomeric material extending completely through the body portion (11) provides the more resilient feel which has been achieved with the present invention.

Preferably the elastomeric material also extends downwardly through the slot opening (18) to the bottom (19) of the putter body portion (11). This slot (18) with the elastomeric material therein tends to hold the elastomeric material in place within the putter body portion (11).

In addition, the outwardly extending slots (20) and (22) further assist in holding the elastomeric material in place, which defines the putter from surface.

It should also be stressed that the opening (16) may extend only a relatively short transverse distance along the putter front face (14), or it may extend nearly the entire distance of the putter front face (14) as desired.

In accordance with another feature of the present invention, the putter is provided with a pair of vertical walls (30 and 32) extending rearwardly from the putter body portion (11) which are utilized to mount a putter guiding assembly (40) and/or a putter weight assembly (50) the vertical walls (30 and 32) may be attached to the rear face (34) by welding, with mechanical fasteners, or most preferably by casting the walls integral with the putter body portion (110.

The putter guiding assembly (40) preferably includes a shape (42) to direct the path of the ball as the ball is struck. The shape (42) is conveniently triangular having a point (44) to direct the path of the ball as the ball is struck as shown in applicant's Design Pat. No. 363,101 granted Oct. 10, 1995, hereby incorporated into the present application by this reference. The shape (42) may be drawn or formed on the body portion (41) of the guiding assembly (40).

Figure 7:
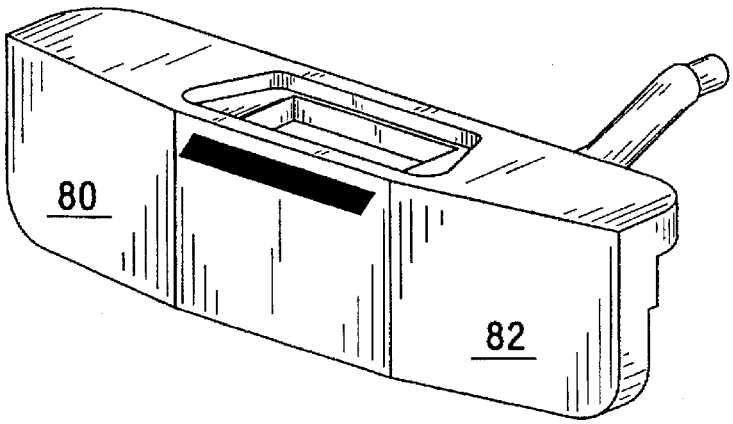
FIG. 7 is a perspective bottom view of the putter of the present invention.

The optional putter weight assembly (50) includes weight members (52, 54, etc.) (FIG. 7), which may be provided for various green speeds encountered on wet greens or relatively dry greens. The number of weight pieces may vary in accordance with the green speeds or other factors, including feel of the putter..

Means for holding the guiding assembly and/or weight assembly in place are provided indicated at 60. The means for holding these assemblies in place, preferably comprise mechanical fasteners (62) which may include a threaded opening (64, 65) which receives a threaded screw (66) having a non-round head (68) which can be accessed by a tool (70) including a shank portion (72) and a leg (74) having a non-round end (76) which engages a non-round slot on the external surface of the screw. One or more such mechanical fastener arrangements (60) may be provided, for example one in each of walls, (30 and 32).

To provide a sound base and provide for good putter feel, the bottom portion (19) includes a outwardly extending portions (80 and 82) which are inclined with respect to the horizontal at an angle (a) of about 5 to 25 degrees. These outwardly extending portions (80 and 82) include a step (84, 86) to reinforce the front face.

The resiliency of the elastomeric material is an important feature of the present invention and this elastomeric material should be of sufficient resiliency to provide improved resilience over the arrangements currently on the market such as in U.S. Pat. Nos. 4,422,638 and 3,211,455 which utilize elastomeric putting surfaces but have metallic backings which reduce the resiliency effect of the elastomeric material.

The elastomeric material may be any of the known elastomeric materials achieving a Durometer D scale value of at least about 60. Polyurethane is one example of a suitable elastomeric material but other polymeric materials known in the art to achieve this level of Durometer D scale value and at the same time being sufficiently rugged to withstand golf ball impacts on a sustained basis may be used.

What is claimed is:

1. A golf putter comprising: a putter body portion with a width and a bottom having a handle extending upwardly therefrom to be grasped by a user, said body portion containing a first opening on the putter face extending along the width of the body portion; said first opening being filled with an elastomeric material having a resiliency of at least a Durometer value of at least about 60 D scale, and having sufficient strength to withstand repeated impacts with a golf ball during putting; and means for maintaining said elastomeric material within said putter body portion; said means for maintaining the elastomeric material in place within said body portion including a second opening in communication with said first opening and extending inwardly behind the face of said body portion through the bottom of the putter; said means for maintaining the elastomeric material within the putter body portion further comprising laterally spaced slots extending outwardly from said first opening and extending less than the width of the body portion on either side of the first opening.

2. A putter according to claim 1 including a putter guiding assembly located rearwardly of said body portion and including a contour on its upper surface to direct the ball during putting.

3. A putter according to claim 2 including means for providing additional weight located rearwardly of said putter body portion.

4. A putter according to claim 3 wherein means for providing additional weights are provided which are integral with said guiding assembly.

5. A putter according to claim 1 wherein said elastomeric material is polyurethane.

6. A putter according to claim 1 wherein said putter body portion is made of a metal selected from aluminum alloy and copper alloy.

7. A golf putter comprising: a putter body portion with a width and a bottom having a handle extending upwardly therefrom to be grasped by a user; said body portion containing a first opening on the putter face extending along the width of the body portion; said first opening being filled with an elastomeric material having a resiliency of at least a Durometer value of at least about 60 D scale, and having sufficient strength to withstand repeated impacts with a golf ball during puffing; and means for maintaining said elastomeric material within said putter body portion; said means for maintaining the elastomeric material in place within said body portion includes a second opening in communication with said first opening and extending rearwardly behind the face of the body portion through the bottom of the putter; said means for maintaining the elastomeric material within the putter body portion further comprises laterally spaced slots extending outwardly from said first opening and extending less than the width of the body portion on either side of the first opening, said putter including a putter guiding assembly located rearwardly of said body portion and including a contour on its upper surface to direct the ball during putting; and including means for providing additional weight integral with said guiding assembly located rearwardly of said putter body portion below said guiding assembly.

8. A putter according to claim 7 wherein said guiding assembly includes a triangular upper surface with a point of the triangle directing the path of the ball.

9. A putter according to claim 8 wherein means are provided for installing a plurality of weights.

10. A putter according to claim 9 wherein means for maintaining said guiding assembly and said weight assembly are provided.

11. A putter according to claim 10 wherein the means for maintaining said guiding assembly and said weight assembly in place comprise a pair of vertical plates extending outwardly from said putter body portion.

12. A putter according to claim 11 wherein means are provided for maintaining said guiding assembly and said weight assembly within said spaced plates.

13. A putter according to claim 12 wherein the means for maintaining said guiding assembly and said weight assembly in place comprises mechanical fasteners.

14. A putter according to claim 13 wherein the mechanical fasteners comprise at least one threaded opening in at least one of said plates and at least one screw extending through at least one of said plates into said weight assembly.

15. A putter according to claim 7 wherein means for maintaining said guiding assembly and said weight assembly in place are provided comprising a pair of vertical plates extending outwardly from said putter body portion.

* * * * *